US011560901B2

(12) United States Patent
Perez et al.

(10) Patent No.: US 11,560,901 B2
(45) Date of Patent: Jan. 24, 2023

(54) ACTIVE UNLOADING DEVICE FOR MIXED FLOW COMPRESSORS

(71) Applicant: Danfoss A/S, Nordborg (DK)

(72) Inventors: Alonso Perez, Fort Lauderdale, FL (US); Tianlei Li, Tallahassee, FL (US); Jin Yan, Tallahassee, FL (US)

(73) Assignee: Danfoss A/S

( * ) Notice: Subject to any disclaimer, the term of this patent is extended or adjusted under 35 U.S.C. 154(b) by 0 days.

(21) Appl. No.: 17/640,536

(22) PCT Filed: Nov. 11, 2020

(86) PCT No.: PCT/US2020/059929
§ 371 (c)(1),
(2) Date: Mar. 4, 2022

(87) PCT Pub. No.: WO2021/096905
PCT Pub. Date: May 20, 2021

(65) Prior Publication Data

US 2022/0341437 A1 Oct. 27, 2022

Related U.S. Application Data

(60) Provisional application No. 62/934,596, filed on Nov. 13, 2019.

(51) Int. Cl.

| | |
|---|---|
| ***F25B 1/10*** | (2006.01) |
| ***F04D 29/44*** | (2006.01) |
| ***F04D 25/06*** | (2006.01) |
| ***F25B 1/053*** | (2006.01) |

(52) U.S. Cl.
CPC ..... *F04D 29/444* (2013.01); *F04D 25/06* (2013.01); *F25B 1/053* (2013.01); *F25B 1/10* (2013.01)

(58) Field of Classification Search
CPC ..... F04D 29/44; F04D 29/444; F25B 1/10
See application file for complete search history.

(56) References Cited

U.S. PATENT DOCUMENTS

| | | | | |
|---|---|---|---|---|
| 4,292,807 | A * | 10/1981 | Rannenberg | F01D 17/143 60/601 |
| 5,011,371 | A * | 4/1991 | Gottemoller | F04D 29/444 415/914 |
| 8,414,249 | B2 * | 4/2013 | Nikpour | F04D 27/02 415/58.4 |
| 8,845,268 | B2 * | 9/2014 | Nikpour | F04D 29/4213 415/58.4 |
| 9,206,677 | B2 * | 12/2015 | Song | F04D 13/10 |

(Continued)

FOREIGN PATENT DOCUMENTS

WO 2018038818 A1 3/2018

*Primary Examiner* — Filip Zec
(74) *Attorney, Agent, or Firm* — Carlson, Gaskey & Old, P.C.

(57) ABSTRACT

A compressor according to an exemplary aspect of the present disclosure includes, among other things, a mixed compression stage having both axial and radial components arranged along a main flow path, and a radial compression stage having an impeller with a plurality of vanes arranged in the main flow path downstream of the mixed compression stage. The impeller is configured to rotate about an axis and has an outlet downstream of the vanes. A movable diffuser is arranged at the outlet, and the movable diffuser is configured to vary an area of the outlet.

20 Claims, 5 Drawing Sheets

(56) References Cited

U.S. PATENT DOCUMENTS

| | | | | |
|---|---|---|---|---|
| 9,353,765 | B2 * | 5/2016 | Haley | F04D 29/4213 |
| 9,611,862 | B2 * | 4/2017 | Brillet | F02C 7/18 |
| 11,421,708 | B2 * | 8/2022 | Cousins | F04D 25/082 |
| 2007/0204615 | A1 * | 9/2007 | Vrbas | F02B 37/013 60/605.1 |
| 2009/0205362 | A1 | 8/2009 | Haley | |
| 2016/0281732 | A1 * | 9/2016 | Lardy | F04D 29/4213 |
| 2019/0107111 | A1 | 4/2019 | Goldenberg et al. | |
| 2020/0173464 | A1 * | 6/2020 | Oh | F04D 17/10 |
| 2020/0208642 | A1 | 7/2020 | Yan et al. | |

* cited by examiner

ACTIVE UNLOADING DEVICE FOR MIXED FLOW COMPRESSORS

PRIORITY CLAIM

This application claims the benefit of U.S. Provisional Application No. 62/934,596, filed on Nov. 13, 2019.

TECHNICAL FIELD

This disclosure relates to an unloading device for a compressor having a mixed compression stage and a radial compression stage. The compressor is used in a heating, ventilation, and air conditioning (HVAC) chiller system, for example.

BACKGROUND

Refrigerant compressors are used to circulate refrigerant in a chiller via a refrigerant loop. Refrigerant loops are known to include a condenser, an expansion device, and an evaporator. The compressor compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many refrigerant compressors are centrifugal compressors and have an electric motor that drives at least one impeller to compress refrigerant. Fluid flows into the impeller in an axial direction, and is expelled radially from the impeller. The fluid is then directed downstream for use in the chiller system.

SUMMARY

A compressor according to an exemplary aspect of the present disclosure includes, among other things, a mixed compression stage having both axial and radial components arranged along a main flow path, and a radial compression stage having an impeller with a plurality of vanes arranged in the main flow path downstream of the mixed compression stage. The impeller is configured to rotate about an axis and has an outlet downstream of the vanes. A movable diffuser is arranged at the outlet, and the movable diffuser is configured to vary an area of the outlet.

In a further embodiment, the movable diffuser is configured to extend an operating range of the compressor.

In a further embodiment, the movable diffuser is movable between a first position and a second position, wherein the first position does not obstruct the outlet, and the second position partially obstructs the outlet.

In a further embodiment, the movable diffuser is configured to be in the first position during a normal flow condition, and the movable diffuser is configured to be in the second position during a surge condition.

In a further embodiment, the movable diffuser is configured to move between the first and second positions by translating in an axial direction.

In a further embodiment, the movable diffuser has a chamfer configured to provide a smooth flow path at the outlet.

In a further embodiment, the movable diffuser is a ring shaped structure arranged about the axis.

In a further embodiment, the axial component is greater than the radial component.

In a further embodiment, the main flow path is defined by an outer wall and an inner wall and the outer and inner walls are curved at the mixed compression stage.

In a further embodiment, the outer and inner walls each have an inflection point and smoothly transition to being parallel to one another downstream of the mixed compression stage.

In a further embodiment, an array of static diffuser vanes is arranged between the mixed compression stage and the radial compression stage.

In a further embodiment, the main flow path turns by substantially 180 degrees at a bend between the mixed compression stage and the radial compression stage.

In a further embodiment, a plurality of deswirl vanes are arranged between the bend and the radial compression stage.

In a further embodiment, the impeller rotates on a shaft that is driven by a motor.

In a further embodiment, the refrigerant compressor is used in a heating, ventilation, and air conditioning (HVAC) chiller system.

A refrigerant system according to an exemplary aspect of the present disclosure includes, among other things, a main refrigerant loop including a compressor, a condenser, an evaporator, and an expansion device. The compressor includes a mixed compression stage having both axial and radial components arranged along a main flow path, and a radial compression stage having an impeller with a plurality of vanes arranged in the main flow path downstream of the mixed compression stage. The impeller is configured to rotate about an axis and has an outlet downstream of the vanes. A movable diffuser is arranged at the outlet, and the movable diffuser is configured to vary an area of the outlet.

In a further embodiment, the movable diffuser is movable between a first position and a second position by translating in an axial direction, wherein the first position does not obstruct the outlet, and the second position partially obstructs the outlet.

In a further embodiment, the movable diffuser is configured to be in the first position during a normal flow condition, and the movable diffuser is configured to be in the second position during a surge condition.

In a further embodiment, the movable diffuser is a ring shaped structure arranged about the axis and the movable diffuser has a chamfer configured to provide a smooth flow path at the outlet.

In a further embodiment, the axial component is greater than the radial component.

DETAILED DESCRIPTION

Figure 1:
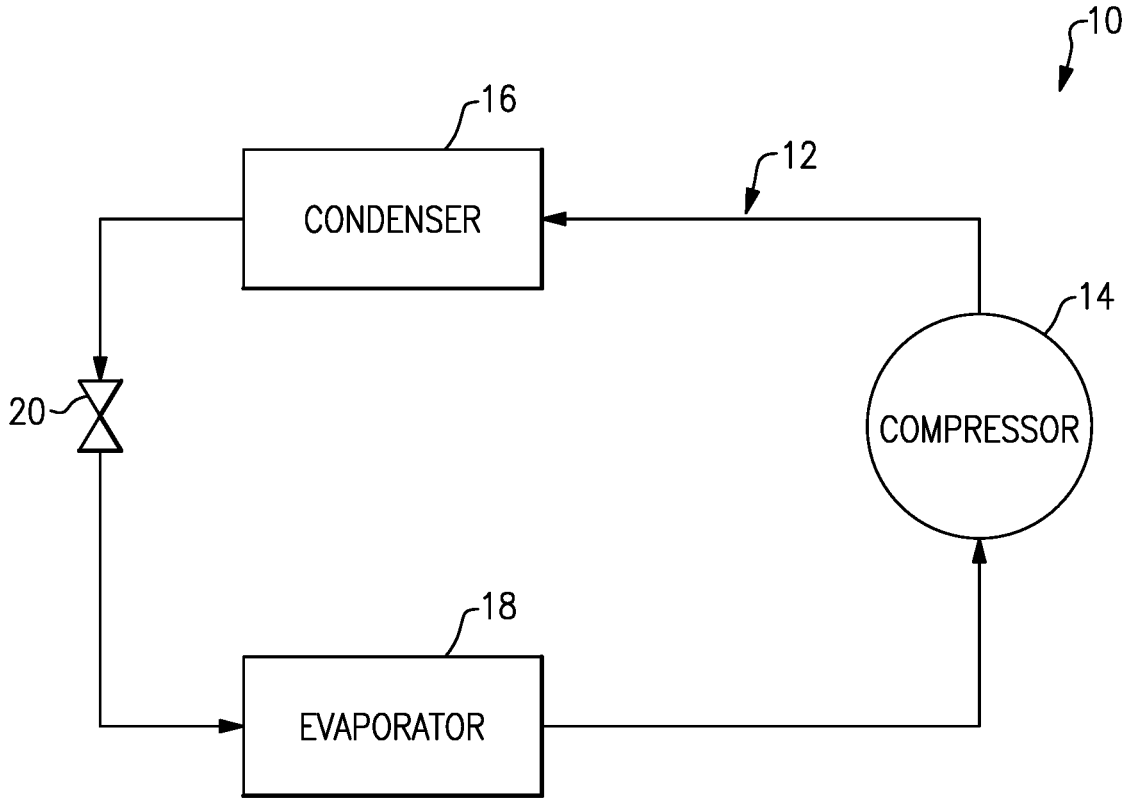
FIG. 1 schematically illustrates a refrigerant system.

FIG. 1 illustrates a refrigerant system 10. The refrigerant system 10 includes a main refrigerant loop, or circuit, 12 in communication with a compressor 14, a condenser 16, an evaporator 18, and an expansion device 20. This refrigerant system 10 may be used in a chiller, for example. In that example, a cooling tower may be in fluid communication with the condenser 16. While a particular example of the refrigerant system 10 is shown, this application extends to other refrigerant system configurations, including configurations that do not include a chiller. For instance, the main refrigerant loop 12 can include an economizer downstream of the condenser 16 and upstream of the expansion device 20.

Figure 2:
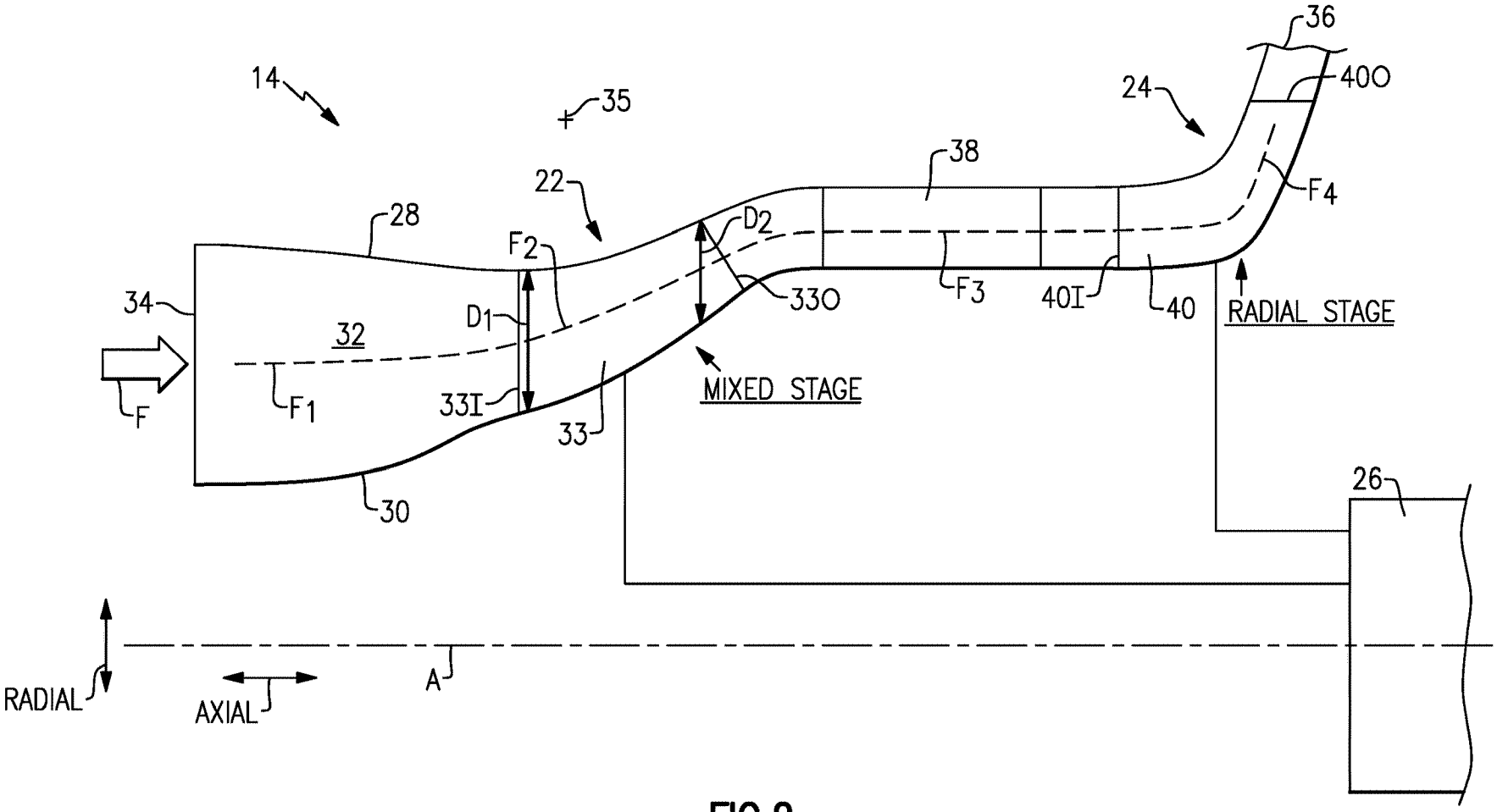
FIG. 2 schematically illustrates a first example compressor having two compression stages, with a first compression stage being a mixed compression stage and a second compression stage being a radial compression stage.

FIG. 2 schematically illustrates a first example refrigerant compressor according to this disclosure. In FIG. 2, a portion of the compressor 14 is shown in cross-section. It should be understood that FIG. 2 only illustrates an upper portion of the compressor 14, and that the compressor 14 would essentially include the same structure reflected about its central longitudinal axis A.

In this example, the compressor 14 has two compression stages 22, 24 spaced-apart from one another along the axis A. The compression stages 22, 24 each include a plurality of blades (e.g., an array of blades) arranged on a disk, for example, and rotatable about the axis A via a motor 26. In this example, the motor 26 is an electric motor arranged about the axis A. The compression stages 22, 24 may be coupled to the motor 26 by separate shafts or by a common shaft. Two shafts are shown schematically in FIG. 2.

The compressor 14 includes an outer wall 28 and an inner wall 30 which together bound a main flow path 32. The main flow path 32 extends between an inlet 34 and an outlet 36 of the compressor 14. The outer and inner walls 28, 30 may be provided by one or more structures.

Between the inlet 34 and the first compression stage 22, fluid F within the main flow path 32 flows in a first direction $F_1$, which is an axial direction substantially parallel to the axis A. The "axial" direction is labeled in FIG. 2 for reference. The fluid F is refrigerant in this disclosure.

The first compression stage 22 includes a plurality of blades 33 arranged for rotation about the axis A. Adjacent the inlet 33I of the first compression stage 22, the outer and inner walls 28, 30 are spaced-apart by a radial distance $D_1$. Adjacent the outlet 33O of the first compression stage 22, the outer and inner walls 28, 30 are spaced-apart by a radial distance $D_2$, which is less than $D_1$. The distances $D_1$ and $D_2$ are measured normally to the axis A.

Within the first compression stage 22, the outer and inner walls 28, 30 are arranged such that the fluid F is directed in a second direction $F_2$, which has both axial and radial components. In this regard, the first compression stage 22 may be referred to as a "mixed" compression stage, because the fluid F within the first compression stage 22 has both axial and radial flow components. The "radial" direction is labeled in FIG. 2 for reference.

In one example, the second direction $F_2$ is inclined at an angle of less than 45° relative to the first direction $F_1$ and relative to the axis A. In this way, the second direction $F_2$ is primarily axial but also has a radial component (i.e., the axial component is greater than the radial component).

Further, between the inlet 33I and outlet 33O, the inner and outer walls 28, 30 are not straight. Rather, the inner and outer walls 28, 30 are curved. Specifically, in this example, the inner and outer walls 28, 30 are curved such that they are generally concave within the first compression stage 22 when viewed from a radially outer location, such as the location 35 in FIG. 2. Thus, the fluid F smoothly transitions from a purely axial flow to a mixed flow having both axial and radial components.

Downstream of the first compression stage 22, the outer and inner walls 28, 30 have inflection points and smoothly transition such that they are substantially parallel to one another. As such, the fluid F is directed in a third direction $F_3$, which is substantially parallel to both the first direction $F_1$ and the axis A. As the fluid F is flowing in the third direction $F_3$, the fluid F also flows through an array of static diffuser vanes 38 in this example.

Downstream of the diffuser vanes 38, the fluid F is directed to the second compression stage 24, which in this example includes an impeller 40 configured to turn the fluid F flowing in a substantially axial direction to a substantially radial direction. In particular, the impeller 40 includes an inlet 401 arranged axially, substantially parallel to the axis A, and an outlet 40O arranged radially, substantially perpendicular to the axis A.

In particular, the fluid F enters the second compression stage 24 flowing in the third direction $F_3$ and exits the second compression stage 24 flowing in a fourth direction $F_4$, which in one example is substantially parallel to the radial direction. In this disclosure, the fourth direction $F_4$ is inclined relative to the axis A at an angle greater than 45° and less than or equal to 90°. In one particular example, the fourth direction $F_4$ is substantially equal to 90°. In this way, the second stage compression 24 may be referred to as a radial compression stage.

The combination of the first compression stage 22 having both axial and radial components (i.e., second direction $F_2$ is inclined at less than 45°) with the second compression stage 24 being primarily radial (i.e., the fourth direction $F_4$ is substantially equal to 90°), the compressor 14 is more compact than a compressor that includes two radial impellers, for example. Accordingly, the compressor 14 strikes a unique balance between being compact and efficient.

Figure 3:
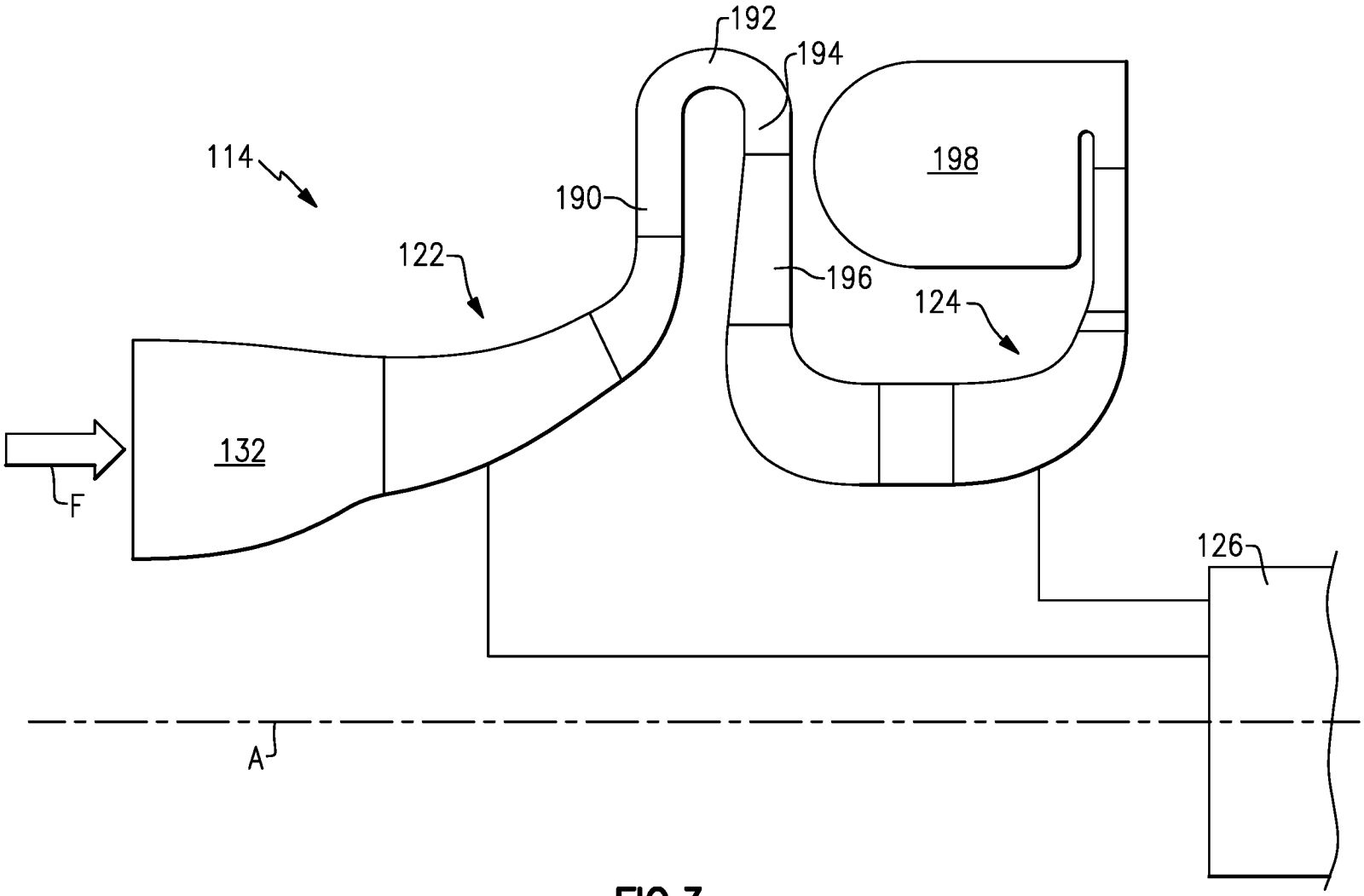
FIG. 3 schematically illustrates a second example compressor having two compression stages, with a first compression stage being a mixed compression stage and a second compression stage being a radial compression stage.

FIG. 3 schematically illustrates a second example refrigerant compressor according to this disclosure. To the extent not otherwise described or shown, the compressor 114 corresponds to the compressor 14 of FIG. 2, with like parts having reference numerals preappended with a "1."

Like the compressor 14, the compressor 114 has two compression stages 122, 124 spaced-apart from one another along an axis A. The first compression stage 122 is a "mixed" compression stage and is arranged substantially similar to the first compression stage 22. The second compression stage 124 is a radial compression stage and is likewise arranged substantially similar to the second compression stage 24.

Unlike the compressor 14, the main flow path 132 of the compressor 114 includes a 180-degree bend between the first and second compression stages 122, 124. Specifically, downstream of the first compression stage 122, the main flow path 132 turns and projects radially outward from the axis A. Specifically, the main flow path 132 is substantially normal to the axis A within a first section 190. The main flow path 132 turns again by substantially 180 degrees in a cross-over bend 192, such that the main flow path 132 projects radially inward toward the axis A in a second section 194, which may be referred to as a return channel. The second section includes deswirl vanes 196 in this example, which ready the flow of fluid F for the second compression stage 124. Further, downstream of the second compression stage 124, the compressor 114 includes an outlet volute 198 which spirals about the axis A and leads to a compressor outlet. The compressor 14 may also include an outlet volute.

Figure 4:
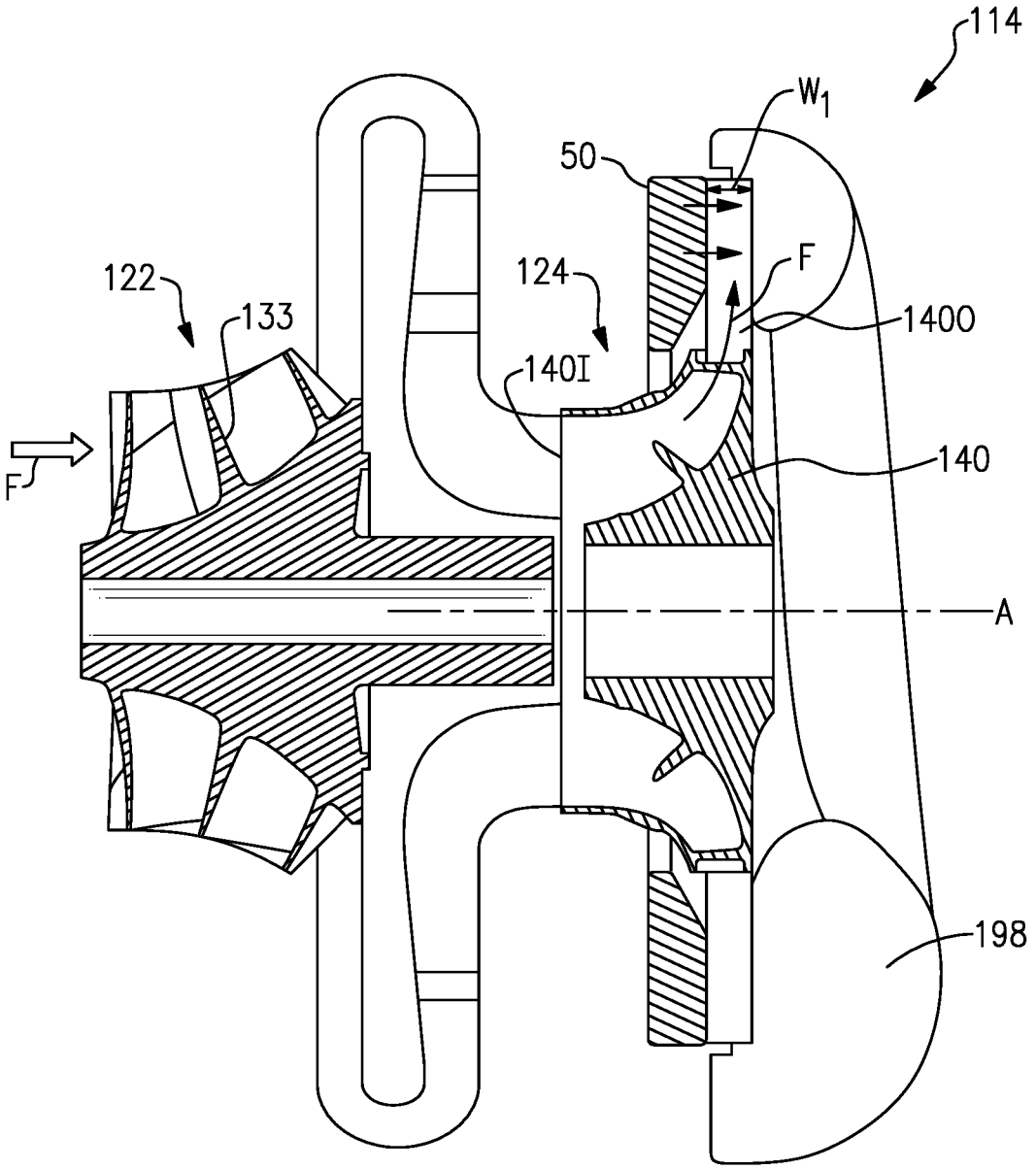
FIG. 4 illustrates an example compressor having an unloading device in a first position.

FIG. 4 illustrates the compressor 114 having an example movable diffuser 50 in a first position. The diffuser 50 is arranged at the outlet 140O of the second compression stage 124. The movable diffuser 50 may be arranged in the outlet volute 198 downstream of the impeller 140. The first position may correspond with a normal flow condition, for example. In the first position, the diffuser 50 is arranged such that it does not obstruct the outlet 140O. A width $W_1$ is defined within the outlet 140O at the diffuser 50. The diffuser 50 may be a generally ring shaped structure arranged about the compressor axis A.

Figure 5:
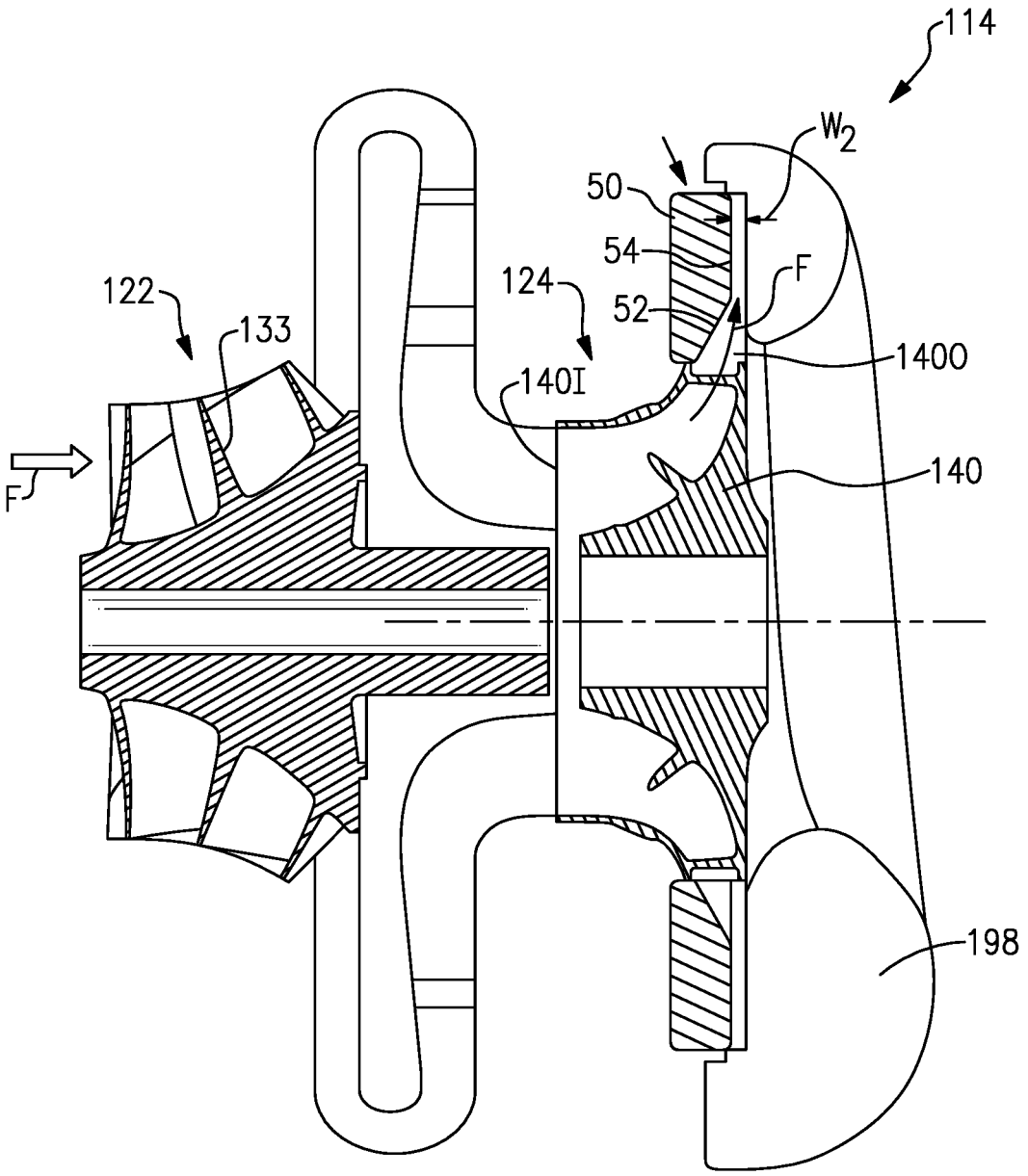
FIG. 5 illustrates the example compressor having the unloading device in a second position.

FIG. 5 illustrates the compressor 114 with the example movable diffuser 50 in a second position. The second position may correspond with a surge condition, for example. Surge conditions may occur when the compressor 114 is operating at a relatively low capacity. During surge conditions, the flow of fluid F through the compressor 114 does not have sufficient radial velocity to escape the compressor, and may begin to flow backwards. In the second position, the diffuser 50 is moved to a position that partially obstructs the outlet 140O. That is, the diffuser 50 decreases the exit area for the fluid F through the outlet 140O. In the second position, a width $W_2$ is defined within the outlet 40O at the diffuser 50. The width $W_2$ is smaller than the width $W_1$. Thus, when the diffuser 50 is in the second position, an exit area of the outlet 140O is decreased. The diffuser 50 may move between the first and second positions by translating in a substantially axial direction, for example. The diffuser 50 may have a chamfer 52 along a flow path side 54. The chamfer 52 may provide a smooth flow path for the fluid F as it exits the impeller 140.

The movable diffuser 50 works as an active unloading device. During surge conditions, the flow of fluid F through the compressor 114 does not have sufficient radial velocity to escape the volute. To prevent this, the movable diffuser 50 is moved such that it decreases the effective area of the outlet. This decreased area increases the velocity of the fluid F, allowing the fluid F to escape the compressor 114. The movable diffuser 50 actively controls the flow of fluid F to increase performance of the compressor 114 in the surge region. The movable diffuser 50 may thus increase the operating range of the compressor 114, by permitting operation at lower capacities.

The described movable diffuser may be used with either radial or mixed flow compression stages. A compressor may include one or more of the described diffusers at one or more compression stages.

It should be understood that terms such as "axial" and "radial" are used above with reference to the normal operational attitude of a compressor. Further, these terms have been used herein for purposes of explanation, and should not be considered otherwise limiting. Terms such "generally," "about," and "substantially" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A refrigerant compressor, comprising:

a mixed compression stage configured such that fluid flowing within the mixed compression stage has both axial and radial components, wherein the mixed compression stage is arranged along a main flow path;

a radial compression stage having an impeller with a plurality of vanes arranged in the main flow path downstream of the mixed compression stage, the impeller configured to rotate about an axis and having an outlet downstream of the vanes; and a movable diffuser arranged at the outlet, the movable diffuser configured to vary an area of the outlet by translating in an axial direction.

2. The refrigerant compressor as recited in claim 1, wherein the movable diffuser is configured to extend an operating range of the compressor.

3. The refrigerant compressor as recited in claim 1, wherein the movable diffuser is movable between a first position and a second position, wherein the first position does not obstruct the outlet, and the second position partially obstructs the outlet.

4. The refrigerant compressor as recited in claim 3, wherein the movable diffuser is configured to be in the first position during a normal flow condition, and the movable diffuser is configured to be in the second position during a surge condition.

5. The refrigerant compressor as recited in claim 3, wherein the movable diffuser is configured to move between the first and second positions by translating in aft the axial direction.

6. The refrigerant compressor as recited in claim 1, wherein the movable diffuser has a chamfer configured to provide a smooth flow path at the outlet.

7. The refrigerant compressor as recited in claim 1, wherein the movable diffuser is a ring shaped structure arranged about the axis.

8. The refrigerant compressor as recited in claim 1, wherein the axial component is greater than the radial component.

9. The refrigerant compressor as recited in claim 1, wherein the main flow path is defined by an outer wall and an inner wall and the outer and inner walls are curved at the mixed compression stage.

10. A refrigerant compressor, comprising:

a mixed compression stage configured such that fluid flowing within the mixed compression stage has both axial and radial components, wherein the mixed compression stage is arranged along a main flow path;

a radial compression stage having an impeller with a plurality of vanes arranged in the main flow path downstream of the mixed compression stage, the impeller configured to rotate about an axis and having an outlet downstream of the vanes;

a movable diffuser arranged at the outlet, the movable diffuser configured to vary an area of the outlet, wherein the main flow path is defined by an outer wall and an inner wall, and wherein the outer and inner walls are curved at the mixed compression stage, and wherein the outer an inner walls each have an inflection point and smoothly transition to being parallel to one another downstream of the mixed compression stage.

11. The refrigerant compressor as recited in claim 1, wherein an array of static diffuser vanes is arranged between the mixed compression stage and the radial compression stage.

12. The refrigerant compressor as recited in claim 1, wherein the main flow path turns by substantially 180 degrees at a bend between the mixed compression stage and the radial compression stage.

13. A refrigerant compressor, comprising:

a mixed compression stage configured such that fluid flowing within the mixed compression stage has both axial and radial components, wherein the mixed compression stage is arranged along a main flow path;

a radial compression stage having an impeller with a plurality of vanes arranged in the main flow path downstream of the mixed compression stage, the impeller configured to rotate about an axis and having an outlet downstream of the vanes;

a movable diffuser arranged at the outlet, the movable diffuser configured to vary an area of the outlet, wherein the main flow path turns by substantially 180 degrees at a bend between the mixed compression stage and the radial compression stage, and wherein a plurality of deswirl vanes are arranged between the bend and the radial compression stage.

14. The refrigerant compressor as recited in claim 1, wherein the impeller rotates on a shaft that is driven by a motor.

15. The refrigerant compressor as recited in claim 1, wherein the refrigerant compressor is used in a heating, ventilation, and air conditioning (HVAC) chiller system.

16. A refrigerant system comprising:

a main refrigerant loop including a compressor, a condenser, an evaporator, and an expansion device, wherein the compressor comprises:

a mixed compression stage configured such that fluid flowing within the mixed compression stage has both axial and radial components, wherein the mixed compression stage is arranged along a main flow path;

a radial compression stage having an impeller with a plurality of vanes arranged in the main flow path downstream of the mixed compression stage, the impeller configured to rotate about an axis and having an outlet downstream of the vanes; and a movable diffuser arranged at the outlet, the movable diffuser configured to vary an area of the outlet by translating in an axial direction.

17. The refrigerant system of claim 16, wherein the movable diffuser is movable between a first position and a second position by translating in the axial direction, wherein the first position does not obstruct the outlet, and the second position partially obstructs the outlet.

18. The refrigerant system of claim 17, wherein the movable diffuser is configured to be in the first position during a normal flow condition, and the movable diffuser is configured to be in the second position during a surge condition.

19. The refrigerant system of claim 16, wherein the movable diffuser is a ring shaped structure arranged about the axis and the movable diffuser has a chamfer configured to provide a smooth flow path at the outlet.

20. The refrigerant system of claim 16, wherein the axial component is greater than the radial component.

* * * * *